US005503028A

United States Patent [19]

Brihier

[11] Patent Number: 5,503,028

[45] Date of Patent: Apr. 2, 1996

[54] TOOL FOR MEASURING TORQUE, SUCH AS AN ELECTRONIC DYNAMOMETER WRENCH

[75] Inventor: Gerard Brihier, Saint Germain les Arpajon, France

[73] Assignee: Facom, Morangis Cedex, France

[21] Appl. No.: 273,456

[22] Filed: Jul. 11, 1994

[30] Foreign Application Priority Data

Jul. 9, 1993 [FR] France ..... 93 08519

[51] Int. Cl.[6] ..... B25B 23/14

[52] U.S. Cl. ..... 73/862.21

[58] Field of Search ..... 73/862.21, 862.23, 73/862.22, 782

[56] References Cited

U.S. PATENT DOCUMENTS

| | | | |
|---|---|---|---|
| 3,298,221 | 1/1967 | Miller et al. | 73/32 |
| 3,329,019 | 7/1967 | Sippin | 73/194 |
| 3,355,944 | 12/1967 | Sippin | 73/194 |
| 3,585,843 | 6/1971 | Stansfeld | 73/32 |
| 4,006,629 | 2/1977 | Barrett et al. | 73/139 |
| 4,208,905 | 6/1980 | Spoor | 73/862.633 |
| 4,212,197 | 7/1980 | Kawai et al. | 73/862.633 |
| 4,622,858 | 11/1986 | Mizerak | 73/861.38 |
| 4,649,758 | 3/1987 | Harbour | 73/782 |
| 4,653,332 | 3/1987 | Simonsen | 73/861.38 |
| 4,680,974 | 7/1987 | Simonsen | 73/861.38 |
| 4,703,660 | 11/1987 | Brenneman | 73/861.38 |
| 4,730,501 | 3/1988 | Levien | 73/861.38 |
| 4,760,744 | 8/1988 | Simonsen et al. | 73/861.38 |
| 4,763,530 | 8/1988 | Mizerak | 73/861.38 |
| 4,768,384 | 9/1988 | Flecken et al. | 73/861.02 |
| 4,793,191 | 12/1988 | Flecken et al. | 73/861.38 |
| 4,949,583 | 8/1990 | Lang et al. | 73/861.37 |
| 4,962,671 | 10/1990 | Stansfeld et al. | 73/861.37 |
| 4,972,724 | 11/1990 | Ricken | 73/861.37 |
| 5,020,375 | 6/1991 | Back-Pedersen et al. | 73/861.38 |
| 5,024,104 | 6/1991 | Dames | 73/861.37 |
| 5,031,468 | 7/1991 | Atkinson et al. | 73/861.37 |
| 5,044,207 | 9/1991 | Atkinson et al. | 73/861.37 |
| 5,069,075 | 12/1991 | Back-Pedersen | 73/861.37 |
| 5,218,873 | 6/1993 | Lang | 73/861.37 |
| 5,261,284 | 11/1993 | Hopkinson | 73/861.37 |
| 5,275,061 | 1/1994 | Young et al. | 73/861.38 |

FOREIGN PATENT DOCUMENTS

| | | |
|---|---|---|
| 0293310 | 11/1988 | European Pat. Off. . |
| 0362696 | 4/1990 | European Pat. Off. . |
| 1034502 | 7/1953 | France . |
| 2400996 | 3/1979 | France . |
| 2538741 | 7/1984 | France . |
| 2584330 | 1/1987 | France . |
| 2626514 | 8/1989 | France . |
| 3139371 | 4/1983 | Germany . |
| 87/00109 | 1/1987 | WIPO . |

*Primary Examiner*—Hezron E. Williams
*Assistant Examiner*—Jewel V. Artis
*Attorney, Agent, or Firm*—Wenderoth, Lind & Ponack

[57] ABSTRACT

This dynamometer wrench (6) includes a head (2) for tightening a member to be screwed, an operating grip (3), a deformable and bending-sensitive handle (7) connecting the grip to the tightening head, and an electronic means (M) for measuring the deformation of the handle and for displaying the tightening torque determined from the deformation measurement. The handle includes a region whose principal cross-section differs from that of the remainder of the handle by virtue of a void (9) and such that it can locally transform shear stresses generated by the operating force (F) into elongation/compression stresses parallel to the surface of the handle. This arrangement makes it possible to compensate for error caused by taking bending alone into consideration when determining the torque transmitted by the tightening head, and hence to avoid exceeding the maximum tightening torque beyond which the profile of the tightening head or the screw thread of the member to be screwed would be damaged, and this by an inexpensive system.

21 Claims, 3 Drawing Sheets

TOOL FOR MEASURING TORQUE, SUCH AS AN ELECTRONIC DYNAMOMETER WRENCH

BACKGROUND OF THE INVENTION

The subject of the present invention is a tool for measuring a torque such as, for example, an electronic dynamometer wrench, that makes it possible to ascertain the value of a torque exerted on a tightening member (nut, screw, bolt or the like) rotated by means of this wrench, and consequently to monitor the tightening accomplished with this wrench.

One of the problems currently encountered in devices for measuring tightening (or untightening) torque of the dynamometer wrench type is that of error due to uncertainty over the point of application of the operating force on the handle of the wrench. In practice, the user does not always position his hand exactly at the same location and/or does not distribute the force between his various fingers in a constant manner.

The version generally regarded as the simplest is a dynamometer wrench 1 using resistive extensometers and electronic signal processing, and is represented in FIG. 1. It comprises an operating head (of a variable model) for the component to be screwed, a flexible part 4 (handle) equipped with an extensometer (M) serving to measure the force F applied perpendicularly to the longitudinal axis of the handle 4, and a manual grip 3 serving to apply the force F at a variable point P. The geometries and embodiments of these various components can, of course, be very variable. The head for operating the component to be screwed can, for example, include a fork wrench or a socket-drive square 5 or a "universal" adaptor.

This simple solution uses a measurement of the bending of the handle of the wrench or of an intermediate component representative of the bending of the handle. The means for measuring bending are required to have a non-zero distance from the axis of the head of the wrench. The coefficient between the measured value and the torque (Co) transmitted by the wrench depends on the position of the point of application of the operating force. Its value is:

$$Co=F\times L \quad (1)$$

The measured value being:

$$Me=F\times(L-D) \quad (2)$$

Direct calculation of the torque from the measured value would therefore lead to an error Er of value equal to:

$$Er=-F\times D \quad (3)$$

It is noted that the absolute value of this error depends only on the value of the force F and is independent of the position of the point of application of the force.

The coefficient is therefore $$L/(L-D) \quad (4)$$

And the exact value of the torque can be calculated (to within a coefficient) with the aid of the formula:

$$C=mex(L/(L-D)) \quad (5)$$

Equation (5) demonstrates that the value obtained corresponds exactly to that of the torque applied to the component to be screwed only if the position of the point of application P of the operating force F is constant. For practical applications this imprecision limits the possibility of using this simple solution when seeking precise measurements. Also, a number of embodiments have been proposed for producing dynamometer wrenches not exhibiting this defect.

A first embodiment, described in particular in French Patent 2,400,996, consists of placing the means for measuring the effort in manner which is physically or functionally concentric with the axis of the screw or nut tightened (untightened) by the wrench. This device leads to an increase in the volume of the wrench in the neighborhood of its head, thus posing problems of accessibility in numerous cases. Moreover, certain types of drives, fork wrench in particular, are not compatible with this solution.

Another entirely mechanical embodiment (French Patent 1,034,502) consists of producing, by means of two blades converging towards the axis of the head of the wrench, a structure which deforms preferentially under the effect of a torque. The influence on the measuring elements eof the forces other than the torque to be measured is markedly reduced, and the measurement can be regarded as depending solely on this torque. The association of this device with electronic measurement by means of resistive extensometers ("strain gauges") is described in French Patent 2,584,330.

A third embodiment, described in U.S. Pat. No. 4,006,629, consists of providing two independent measuring devices located different distances D1 and D2 from the axis of the head of the wrench. The ratio of the values measured by the two devices is influenced by the position of the point of application of the force and makes it possible to thereby determine this position. Once the latter is known, the exact ratio of the measured value to the torque can be determined and the latter can therefore be calculated exactly. In practice, simple addition of the measured values M1 and M2 with suitable coefficients allows an overall solution, and therefore dispenses with carrying out explicit calculations. By reason of the very principle of this device, the overall signal provided by the elongation sensors has a markedly smaller value than the signal corresponding to simple bending, and is therefore more sensitive to disturbances.

A fourth embodiment, described inter alia in French Patent 2,538,741, consists of mechanically coupling the metallic component whose deformation is measured and the handle of the wrench in such a way that only the forces corresponding to the transmission of a torque are transmitted to the part serving in the measurement of the force. In general, this type of solution employs mechanical devices of the articulation type which, by reason of the imperfections inherent in this function, leads to a limitation on the possible precision.

These various solutions lead to markedly more complex and more expensive embodiments than the straight-forward measuring of bending in the neighborhood of the handle of the wrench.

SUMMARY OF THE INVENTION

The subject of the present invention is a device that makes it possible to circumvent the errors due to the position of the point of application of the operating force, and is designed in such a way that it involves no or little substantial increase in the retail price of the wrench.

The electronic dynamometer wrench addressed by the invention is of the type including a head for tightening a member to be screwed, a manual operating grip, a deformable and bending-sensitive handle connecting the grip to the tightening head, as well as electronic means for measuring the deformation of the handle and for displaying the tightening torque determined from the deformation measurement.

According to the invention, the handle includes a region whose principal cross-section differs from that of the remainder of the handle such that it can locally transform shear stresses generated by the operating force into elongation/compression stresses parallel to the surface of the handle. The measuring means are produced so as to be sensitive to the stresses due to bending and to shear in proportions such that the influence of the shear stresses compensates for error caused by taking into consideration the bending alone when determining the torque transmitted by the tightening head.

It is observed that under these conditions the measurement error due to the position of the point of application of the operating force is reduced or eliminated, thus enabling the user to comply with the nominal value of the torque.

BRIEF DESCRIPTION OF THE DRAWINGS

Other features and advantages of the invention will emerge in the course of the description which follows, made with reference to the appended drawings which illustrate several embodiments thereof by way of non-limiting examples.

DETAILED DESCRIPTION OF THE PREFERRED EMBODIMENT

Figure 1:
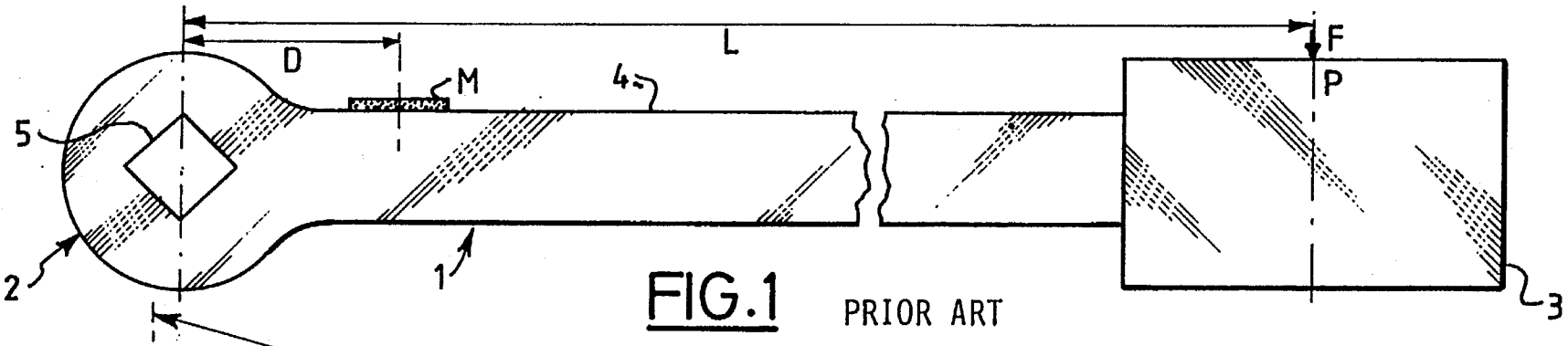
FIG.1 PRIOR ART
FIG. 1 is a view in longitudinal elevation of a known dynamometer wrench.

A dynamometer wrench 1 represented in FIG. 1, known per se, includes an appropriate tightening portion 5, whose cross-section is, for example, square, as shown or rectangular or hexagonal, etc. An extensometer M can be connected, in a manner known per se and not represented, to an electronic circuit for measuring and displaying the tightening torque exerted via the shaft 5.

Consequently if the force F is applied along the normal to a handle or bar 4 at a point P located a distance L from the geometrical tightening axis (perpendicular to the plane of FIG. 1), this distance L being variable as a function of the point of application of the fingers of the user on the handle 3, it is observed, after analysis, that two different stresses are introduced:

- a shear stress, constant in the region located between P and 2, and hence at the point M. This stress depends only on the value of the force F;
- a bending stress proportional to the-value of the force F and to the distance separating the point P from the measurement point M.

At the measurement point M there therefore exist stresses such that a suitable measuring system having a sensitivity Sc in respect of the shear stresses and Sf in respect of the bending stresses would provide an indication of value V equal to:

$$V=F\times Sc+F\times Sf\times(L-D) \tag{6}$$

Comparing equation (6) with equations (2) and (3), the analogy is observed between the second term on the right of equation (6) and equation (2), as well as that existing between equation (3) and the first term of equation (6). Indeed, in both these latter cases, the value depends, to within constants, only on that of the force F.

If in respect of the measuring device M, the ratio Sc/Sf of the sensitivities in shear and in bending of elementary and separate measuring devices (M1, M2 . . . ) is made equal to D/U, U being the common unit of length used to express the values of L and D, it is observed that the value V provided by equation (6) is then exactly proportional to the torque transmitted. Indeed, the first term of the right-hand side of this equation exactly compensates the error due to a bending measurement alone, which measurement is expressed by the second term of the right-hand side.

For the subsequent explanation, and for the purpose of clarifying the description, only the case of sensitive elements of the measuring members (M) consisting of stuck-on resistive extensometers (strain gauges) will be considered. It is however obvious that known measurement means of some other type can be used within the scope of the present invention.

Measurement of the bending stresses is carried out in a conventional manner by means of resistive extensometers stuck onto the appropriate faces of the bar.

Measurement of the shear stresses can be carried out by conventional methods for this type of-measurement, for example by means of extensometers stuck onto the lateral faces of the bar. However, this solution leads to costs which are close to those of the known solutions, this limiting the practical attraction of this solution to special cases. The signal provided by the extensometers measuring the shear can then be too weak to be combined directly (in accordance with equation (6)) with the signal from the extensometers providing the bending indication, and it would then be necessary to attenuate the latter signal, and this would be prejudicial to the quality of the measurements.

The solution proposed according to the invention consists in varying the cross-section of the flexible part (4) in the neighborhood of the measuring system (M), so as locally to transform the shear stresses into elongation/compression stresses parallel to the surface. It is then easy to measure these stresses by means of conventional resistive extensometers.

The stresses thus created are superimposed upon those due to bending. By separately measuring the bending stresses in a region with regular cross-section, it is possible to isolate by calculation the value of the stresses due to shear. Another more powerful possibility for measuring bending consists in adding (or subtracting depending on the original signs) the values obtained in two regions in which the shear and bending stresses are of the same value, respectively, but in which their relative sign is in a region the inverse of what it is in the other region.

If the "extensometer" ad "cross-section modification" assembly has been designed appropriately, it is possible to obtain operation such that the output signal from the extensometer corresponds to the sum of the influences from shear and from bending with relative proportions corresponding to those sought, such as data for the coefficients Sc and Sf of equation (6). The desired result is then obtained directly, namely the value of the torque independent of the position of the point of application of the force, without any modification to the basic structure other than the change in cross-section of the bar and the corresponding application of the extensometer.

The user can thereby easily avoid exceeding the nominal value of the torque.

A first favorable solution consists in making, in the handle 4, a void, preferably of constant cross-section, and whose principal axis is perpendicular both to the longitudinal axis of the handle 4 and to the axis of application of the operating force.

Figure 2:
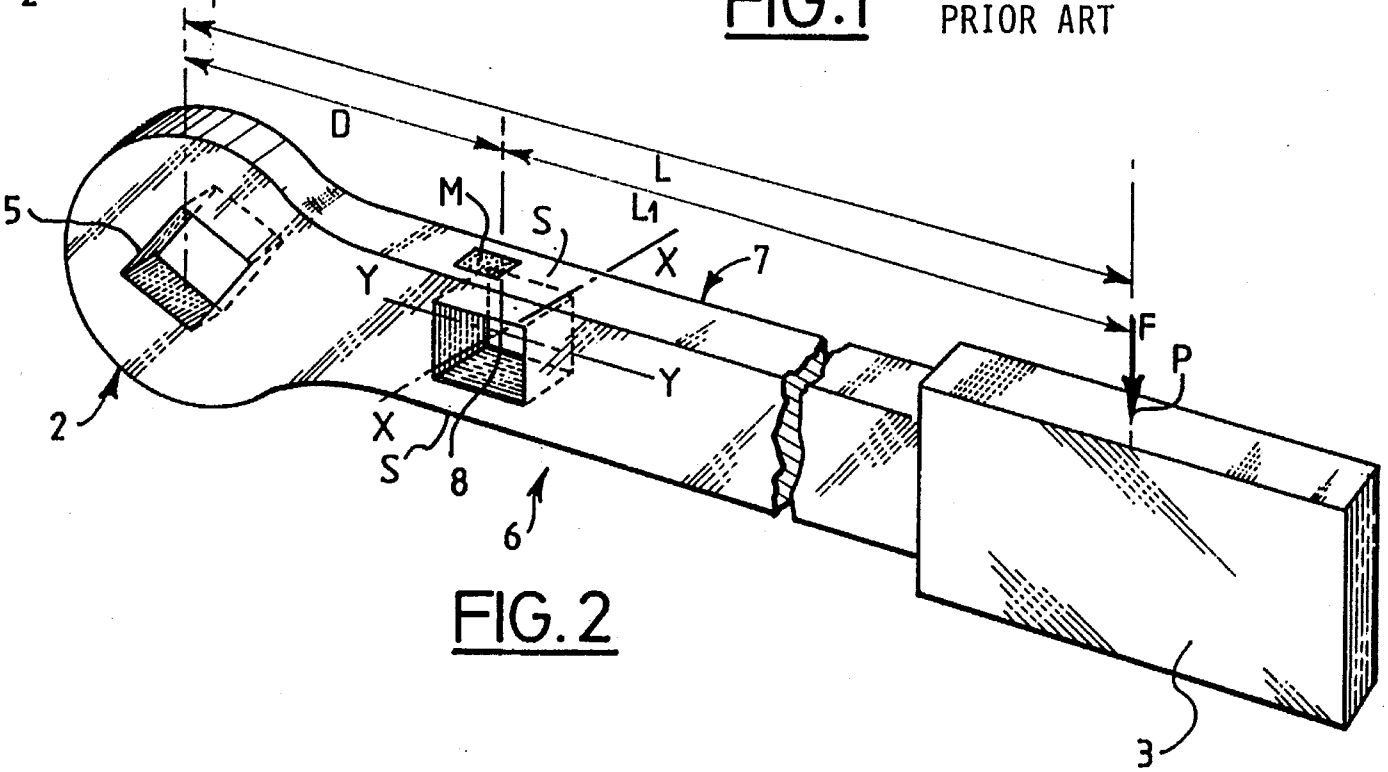
FIG. 2 is a perspective view of a first embodiment of the electronic dynamometer wrench according to the invention.

Thus, in the first embodiment of the wrench 6 according to the invention, illustrated in FIG. 2, the handle 7, of rectangular outline, includes a parallelepipedal drilling 8, the axis XX of which lies a distance D from the geometrical tightening axis of the profile 5 and a distance L1 from the point of application P of the operating force F. The principal axis XX of the void 8 is perpendicular to both the axis of application of the force F and to the longitudinal axis YY of the bar or handle 7. The measuring means M (resistive extensometers) are stuck onto one of the faces of the handle 7 at a suitable place so as to cover a region located substantially square with the void 8, close to the end of this void and either overlapping or not overlapping the region in which the cross-section of the handle 4 is solid.

Figure 3:
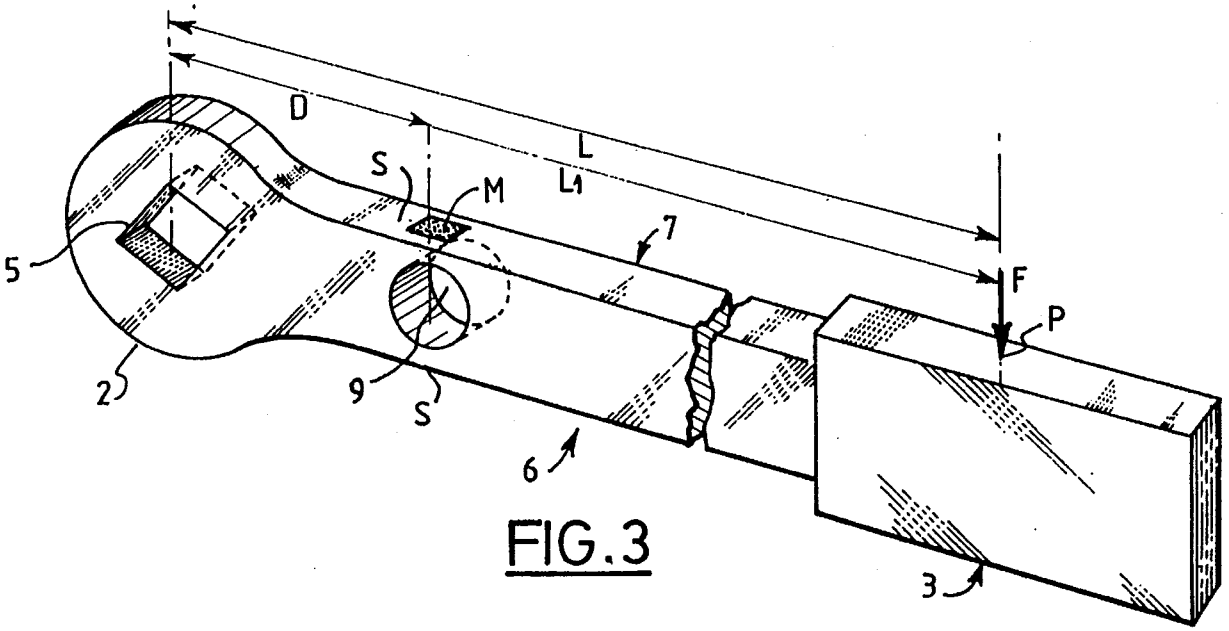
FIG. 3 is a perspective view of a second embodiment of the dynamometer wrench according to the invention.

FIG. 3 illustrates a varied embodiment of the wrench 6 in which the void in the handle 7 consists of a suitably dimensioned cylindrical drilling 9. However, numerous other geometries of the void are possible.

Figure 4:
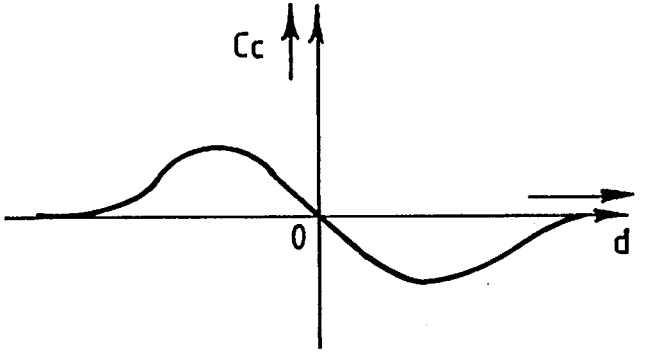
FIGS. 4 and 5 are graphs illustrating the variations in the shear stresses and bending stresses respectively, on either side of the region of the handle of the wrench according to FIG. 3, the cross-section of which has been modified in accordance with the invention.

As illustrated in FIG. 4, for that surface region (S) of the bar located facing the axis of the void 8, the longitudinal stresses induced by shear (Cc) are zero. For the regions located a distance d on either side of the abovementioned region, the longitudinal stresses exist and are of opposite sign. Their value increases and then decreases in proceeding away from the axis of the void.

Figure 5:
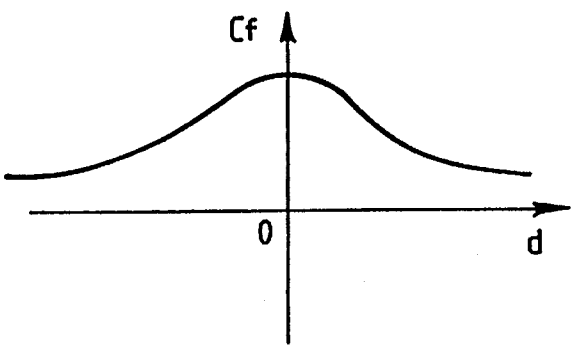

The longitudinal stresses due to bending (Cf) are maximal square with the axis of the void 8 (FIG. 5), and decrease in proceeding away from this point. (These graphs are similar to those which would correspond to the embodiments described later).

Figure 6:
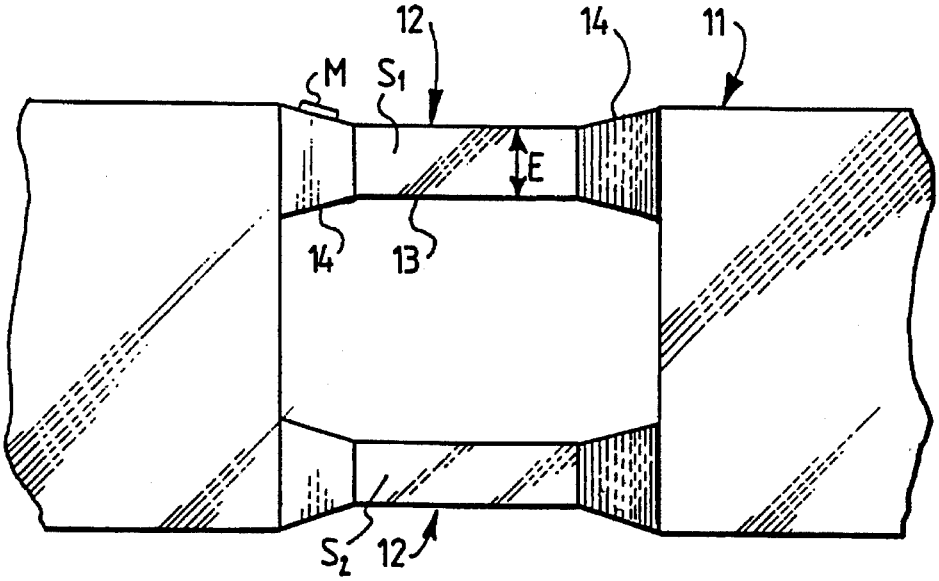
FIG. 6 is a partial view in elevation of a third embodiment of the wrench according to the invention.
Figure 7:
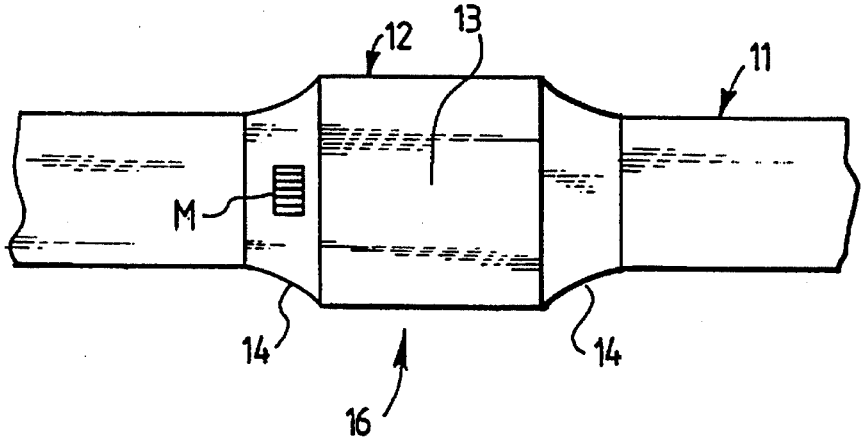
FIG. 7 is a plan view of the handle of the wrench of FIG. 6.

The third embodiment of the dynamometer wrench, illustrated in FIGS. 6 and 7, comprises a handle 11 having a region 16 with a different cross-section from that of the remainder of the handle consists of at least two parallel bars 12 each including an intermediate part 13 of constant cross-section and constant thickness E and two opposite terminal parts 14. The latter have a cross-section which increases from the part 13 up to the junction with the contiguous part of the handle 11. The measurement means M are stuck to one of the terminal parts 14.

Thus, the shape of each bar 12 is such that, over that part 13 of its length, the ratio of the stresses due to the cross-section to those due to shear is approximately constant. Such a characteristic limits the precision required in the positioning of the extensometers M. In the example illustrated in FIGS. 6 and 7 the thickness E of each part 13 intervenes in a substantially proportional manner in respect of the stresses due to bending, and to the power 2 in respect of those due to shear. The width of the bar intervenes proportionally in both cases. The simplified explanation of the operation is as follows: in the relevant region 13, the inertia of the bar 12 is constant, thus leading to an approximately constant sensitivity in respect of the stresses due to bending. In respect of the stresses due to shear, the relevant portion of the bar 12 consitutes an isobending beam.

The outer dimensions of the flexible element (4; 7; 11) in the region of the void (8, 9 . . . ) and those of the void make it possible to define independently the values of the stresses due to shear and those due to bending. Moreover, the distance from square with the axis of the void makes it possible, for a given geometry of the bar and void, to define a region for sticking the extensometer such that the mean of the longitudinal surface stresses in this region corresponds to the distribution (coefficients Sc and Sf) described-earlier. For a given geometry this region may not exist, and it is therefore essential to choose a suitable geometry.

Figure 8:
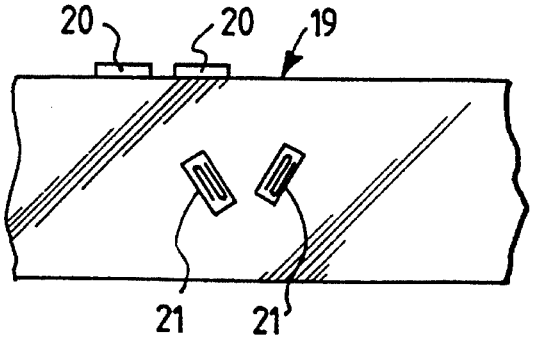
FIG. 8 is a partial side view in elevation of a fourth embodiment of the wrench according to the invention.

The fourth embodiment of the wrench represented in FIG. 8 includes a flexible bar or handle 19 whose principal cross-section has suffered no modification, unlike the embodiments described earlier. The presence on the different faces of the bar of stresses due to bending and to shear respectively is then used. This wrench is equipped with a measuring means consisting of the association of two elementary members corresponding respectively to a separate measurement of the shear forces due to the operating force, and a measurement of the bending forces due to the operating force. This can be achieved for example by associating within the same measurement bridge two pairs of gauges, each pair constituting an elementary "sensor". Indeed, it was explained earlier that the association, in a suitable ratio, of the partial signals originating (or caused by) bending loads or shear loads, makes it possible to obtain an overall signal independent of the position of the point of application P of the force F. Such is also the case if this overall signal is obtained by adding, after possible scaling to obtain the correct ratio, two elementary signals originating respectively from a device for measuring pure bending and a device for measuring pure shear. These devices can be, for example, as represented in FIG. 8, with an extensometer half-bridge 20 placed on one face of the bar 19 which is remote from the neutral fiber for the measurement of bending F and an extensometer half-bridge 21 placed on a lateral face f the handle 19. These extensometric measuring devices are fully known per se and described in detail, particularly in treatises on extensometry, both in respect of elementary measurements and in respect of the effects of an association.

If the devices for measuring bending and shear do not have total insensitivity to the other parameter, the correcting of their reciprocal ratios makes it possible to correct this error by means of additional resistors, for example. It suffices that, in the final signal, the elementary components (bending, shear) be in the correct ratio.

In all cases, the measuring devices applied onto the faces of the bar 19 are sensitive to the stresses due to bending and to those due to shear in proportions such that the influence of the shear stresses compensates the error caused by taking into consideration the bending alone for the calculation of the torque transmitted by the tightening device.

As regards the various embodiments of the wrench illustrated in FIGS. 2 to 7, the following points should be made.

The deformable member consisting of the handle 7, 11 . . . as well as the void 8, 9 . . . for a shape such that the proportion between the stresses due to bending and those due to shear is constant or approximately constant over a certain length of the part receiving the measuring member M, whereas the sensitive part of this measuring member preferably has a constant sensitivity over the measuring length. The extensometer M is positioned in a very precise manner: if for example, depending on the locations of the flexible handle, the values lying between 0 and 40% are recorded for the proportion between the two types of stresses, and if it is desired to obtain a value of 20% for this ratio, the extensometer M is applied precisely at the location where this value of 20% exists. It is also possible to apply a strain gauge in a location where the ratio of the two types of stresses is too small, another gauge in a location where the ratio is too large, and then to associate these gauges in accordance with an adjustable ratio, for example by means of a potentiometer, so as to obtain a ratio corresponding to the exact proportion desired.

The extensometer must be placed in a precise manner, in theory, just as the geometry of the bar must be appropriate, the precision in the positioning of the extensometer possibly being, for example, 0.1 mm. It is also possible to tune the geometry of the void 8, 9, . . . especially by milling, so as to obtain the exact sensitivity desired, and to do so after determining the dimensions of the void by calculation.

One at least of the stress-sensitive members (extensometers) of the measuring means can consist of at least two parts, separate or otherwise. Some of these various parts can be placed in regions of the bar where the stress proportion is slightly greater than the theoretical value, the other parts being placed in regions where the proportion of the stresses is slightly less than the theoretical value.

The various parts of the relevant sensitive members include by design, or are associated with, means allowing discrete or continuous tuning of their overall influence so as to obtain an overall sensitivity corresponding exactly to the sought-after value, the means possibly being merged or separate from those intended for adjusting the proportion of the stresses. There therefore exists, in fact, two types of adjustment: on the one hand, the obtaining of the correct ratio of the effect of bending to that of shear, and on the other hand the obtaining of the exact desired sensitivity for the overall calibration of the wrench. The latter means of adjustment can be completely separate from the previous ones or can be connected to them. For example, the void can be slightly displaced by the milling or laser cutting of a slot, the two adjustments being simultaneously executable in the same operation. The act of facilitating the calibration of the wrench affords a significant advantage, since it reduces the necessary labor, and consequently the retail price of the wrench.

The means of adjustment can themselves include, or are associated with, specific auxiliary means for tuning the stress-sensitivity proportion as a function of a change in geometry of the operating member of the component to be screwed, if this member is removable, and/or of a change of the adaptor between this operating member and the component to be screwed. The specific auxiliary means can be the tightening head 2 with its profiled shaft 5, or else a fork head, or alternatively a universal adaptor, the change of tightening head making it possible to tune the sensitivity to stresses. An adaptor is chosen for a particular use and makes it possible to tune the stress ratios, by virtue of means of the electronic measuring circuit: for example this circuit can include a manual adjusting button having several positions, each corresponding to the distance between the geometrical tightening axis of the adaptor used and the position of the extensometric measuring member M. The positioning of the button on the index corresponding to the length D of the chosen adaptor then automatically tunes the calculation of the tightening torque to the new distance D.

The dynamometer wrench according to the invention can include means making it possible to modify the functional geometry of the void in the operating member, directly or indirectly, by causing a modification of its influence, so as to tune the stress-sensitivity proportion as a function of a change in geometry of the operating member of the component to be screwed, if this member is removable, and/or of a change of the adaptor between this operating member and the component to be screwed. In other words, the geometry is modified in such a way that the extensometer M reacts in the desired proportions, for example by effecting partial reinforcement of the void 8, 9 . . . The geometry of the bar is thus modified, or else the connection (point of application of the forces for example) of the bar with the tightening head is modified, so as to obtain an appropriate alteration in the relative sensitivities of the to types of stresses.

Thus, for example if adaptors of different lengths are used on the same tool, it is possible to choose, for each of the adaptors, the position of the bearing points, between the handle and the adaptor, and hence the points through which the forces are transmitted, so that, in each case, the stresses transmitted to the measuring system are equal to the desired nominal value.

* Numerical example of sizing the bar: the case of a void with rectangular cross-section in the case of a sensitive element of the resistive extensometer sensor type.

Consider a dynamometer wrench intended for measuring a maximum torque of 250 N.m having a length of 400 mm between the axis of the head 2 and the point of application P of the operating force F, and using a deformable element (4, 7 . . .) whose elastic limit has been fixed at 500 N/mm$^2$.

The measuring element is located 40 mm from the axis of the head 2 and the width of the bar is fixed (arbitrarily) at 10 mm and the length of the void at 20 mm. The overall solution not being unique, these values correspond to a choice made in accordance with criteria which do not depend solely on the subject of the invention proper.

This example corresponds to a simplified calculation. Having established the general approach, the elementary calculations are sufficiently known in themselves for there not to be any need to repeat them here.

The point of positioning of the extensometric element (M) on the bar (S) forming the size of the void is chosen one quarter the way along the bar. Higher stresses due to shear exist at the ends of this bar, but their gradient being high, the positioning of the extensometric element at this location would be trickier.

The maximum force applied to the operating point will be: 250/0.4=625 N.

The maximum shear force will be, per bar, (xx): 625/2=312 N.

The proportion between the stresses caused by bending and those caused by shear will be, for the nominal point of application of the force: 360/(400–360) namely 9.

At the point of maximum stress the stress due to shear being twice that at the measuring point, the criteria for complying with the elastic limit lead to taking 9/11 ths of the elastic limit, namely 409 N/mm$^2$, as maximum value of the stress due to bending, and 2/11 ths of the elastic limit, namely 91 N/mm$^2$, as maximum value of the stress due to shear. At the measuring point the stress due to shear is 45.5 N/mm$^2$.

The formula giving the maximum stress is:

$$T=(6\times F\times L)/(B\times E2)$$

Application of this formula to the bar makes it possible to calculate the thickness of the latter:

$$H=V(6\times 312\times 5)/(10\times 91)=4.5 \text{ mm}$$

The formula giving the maximum stress in the case of bending being:

$$T=(6\times F\times L\times H)/(B\times(H3-E3))$$

Application of this formula makes it possible to calculate the total thickness of the sensitive element:

$$(H3-E3)/H=(6\times 625\times 360)/(10\times 409)=330$$

Hence H=18.3 mm

It should be noted that, in this example, the stress due to shear varying linearly along the bar (S) and that due to bending being substantially constant over the length of the bar (S), the fact that the measuring element is not a point element but covers a certain length of the bar does not influence the measurement, in as much as the measuring element (M, 2) has a constant sensitivity over the whole of its length.

The measuring device (M) described earlier as consisting of a single extensometric sensor can of course consist of several sensors mounted in a half-bridge or full bridge. Multi-bridge structures can be produced while remaining within the scope of the invention. In the case of multiple extensometers, the various extensometers can be placed at points of identical stresses (side by side for example), at symmetrical stress points (opposite faces of the bar for example), or at points with different stress values. In the latter case, it is the functional sum of the measured stresses which must comply with the placement criterion defined by the single extensometer. Apart from the ratio of the sensitivities Sc and Sf, which is the basis of the invention, the layout of the extensometer(s) must follow all the customary rules known to those skilled in the art, and can use special layouts, likewise known, in order to obtain advantageous operation (insensitivity to spurious twisting for example).

It should be noted that the voids, such as 8 and 9, preferably have a regular cross-section for reasons of ease of manufacture. However, this cross-section can also be irregular while remaining within the scope of the invention. It is likewise possible to produce several voids instead of just one.

I claim:

1. A tool, comprising:

a head for tightening a member to be tightened with torque;

a manual operating grip;

a bendable handle connecting said grip to said head; and electronic means for determining the torque transmitted by said head by measuring stresses due to shear and bending in said bendable handle such that the shear stresses compensate for error caused by measurement of the bending stresses of said bendable handle, the bending and shear stresses being measured by measuring the deformation of said handle, said means comprising a first member for measuring the shear forces on said bendable handle and a second member for measuring the bending forces on said bendable handle, and for displaying the torque determined from the measurement of the deformation of said bendable handle.

2. A tool, comprising:

a head for tightening a member to be tightened with torque;

a manual operating grip;

a bendable handle connecting said grip to said head, said bendable handle having an upper face, a lateral face and a neutral axis; and electronic means for determining the torque transmitted by said head by measuring stresses due to shear and bending such that the shear stresses compensate for error caused by measurement of the bending stresses of said bendable handle, the bending and shear stresses being measured by measuring the deformation of said handle, said means comprising an extensometer bridge located on said upper face of said bendable handle spaced from said neutral axis of said bendable handle for measuring bending stresses and one chosen from the group consisting of an extensometer bridge and an extensometer half-bridge located on said lateral face of said bendable handle for measuring shear stresses, and for displaying the torque determined from the measurement of the deformation of said bendable handle.

3. A tool, comprising:

a head for tightening a member to be tightened with torque;

a manual operating grip;

a bendable handle connecting said grip to said head, said bendable handle having a surface; and measuring means comprising a measuring system for measuring the deformation of said bendable handle and a display for displaying the torque determined from the measurement of the deformation of said bendable handle;

wherein said bendable handle comprises a portion having a transverse void such that a main cross-section of said portion differs from a main cross-section of the remainder of said bendable handle; and wherein said transverse void is shaped, and said measuring system is located relative to said transverse void, such that the cross-section of said bendable handle changes at the location of said measuring system on said bendable handle such that shear stresses are locally transformed into elongation and compression stresses parallel to the surface of said bendable handle.

4. The tool of claim 3, wherein:

said bendable handle has a longitudinal axis and a control force direction in which force is received for generating torque at said head and which is defined perpendicular to said longitudinal axis; and said transverse void has a regular cross-sectional shape and an axis perpendicular to the longitudinal axis of said bendable handle and the direction of the control force, the control force being measured by the said measuring means.

5. The tool of claim 4, wherein said regular cross-sectional shape is circular.

6. The tool of claim 5, wherein:

said head has an axis;

a principal plane of said bendable handle is defined by a longitudinal axis of said bendable handle and by the axis of said head;

said transverse void is cylindrical and has an axis located in said principal plane of said bendable handle such that two identical areas of deformation are produced in said bendable handle on either side of said void upon bending of said handle.

7. The tool of claim 4, wherein said regular cross-sectional shape is rectangular.

8. The tool of claim 7, wherein said regular cross-sectional shape is square.

9. The tool of claim 3, wherein:

said measuring system of said measuring means comprises stress-sensitive members fixed to said bendable handle having a stress-sensitivity proportion therebetween;

said transverse void has a geometry that is mechanically tunable with said stress-sensitive members fixed to said bendable handle; and a mechanical tuning means is provided with said bendable handle for mechanically tuning said transverse void to a desired value of the stress-sensitivity proportion of said sensitive members without risk of damage to said sensitive members.

10. A tool, comprising:

a head for tightening a member to be tightened with torque;

a manual operating grip;

a bendable handle connecting said grip to said head; and electronic means for determining the torque transmitted by said head by measuring stresses due to shear and bending such that the shear stresses compensate for error caused by measurement of the bending stresses of said bendable handle, the bending and shear stresses being measured by measuring the deformation of said bendable handle, and for displaying the torque determined from the measurement of the deformation of said bendable handle.

11. The tool of claim 10, wherein:

said electronic means comprises a measuring member on said bendable handle, said measuring member having a sensitive part having a measuring length with a constant stress-sensitivity over said measuring length;

said bendable handle has a part thereof receiving said measuring member;

said bendable handle comprises a portion having a transverse void such that a main cross-section of said portion differs from a main cross-section of the remainder of said bendable handle;

said transverse void is shaped, and said measuring member is located relative to said transverse void, such that the cross-section of said bendable handle changes at the location of said measuring member on said bendable handle such that shear stresses are locally transformed into elongation and compression stresses parallel to the surface of said bendable handle; and said transverse void and said bendable handle have a shape such that the proportion between the bending and shear stresses is at least approximately constant over a specified length of said part of said bendable handle receiving said measuring member.

12. The tool of claim 11, wherein said sensitive part has a shear and bending stress-sensitivity proportion, and said tool further comprises means for tuning the stress-sensitivity proportion of said sensitive parts of said measuring member.

13. The tool of claim 10, wherein:

said electronic means comprises a plurality of stress-sensitive members located on said bendable handle;

one of said stress-sensitive members comprises two parts, one of which is located at a region of said bendable handle in which the proportion of shear stress to bending stress is greater than a theoretical value of the proportion and the other of which is located at a region of said bendable handle in which the proportion of shear stress to bending stress is less than a theoretical value of the proportion.

14. The tool of claim 13, and further comprising means for tuning reciprocal influences of said parts of said one of said stress-sensitive members.

15. The tool of claim 14, and further comprising means for tuning overall influences of said two parts of said one of said stress-sensitive members.

16. The tool of claim 10, wherein:

a portion of said bendable handle has a transverse void such that a main cross-section of said portion differs from a main cross-section of the remainder of said bendable handle;

said electronic means has a stress-sensitivity proportion between the bending and shear stresses; and means for modifying the functional geometry of said transverse void in said bendable handle in order to tune the stress-sensitive proportion between the bending and shear stresses as a function of changes in the geometry of an operating member of the member to be tightened with torque and changes of an adaptor between the operating member and the member to be tightened with torque.

17. The tool of claim 10, wherein:

said bendable handle has a region with a cross-section that differs from the cross-section of the remainder of said bendable handle, said region comprising at least two parallel bars, each of said bars having opposite ends, and an intermediate part between said opposite ends, said intermediate part having a constant cross-section, and said opposite ends having a cross-section greater than that of said intermediate part; and said electronic means comprises members for measuring stresses due to shear and bending located on said bendable handle at said region.

18. The tool of claim 7, wherein said opposite ends of said parallel bars are conical.

19. The tool of claim 17, wherein said members for measuring stresses are located at one of said opposite ends.

20. The tool of claim 10, wherein:

said bendable handle has a region with a cross-section that differs from the cross-section of the remainder of said bendable handle, said region comprising a central part having a greater cross-section than the cross-section of the remainder of the bendable handle and two opposite terminal parts having cross-sections decreasing from said central part toward the remainder of said bendable handle until said opposite terminal parts have cross-sections contiguous with and matching the cross-section of the remainder of said bendable handle; and said electronic means comprises members for measuring stresses due to shear and bending located on said bendable handle at one of said opposite terminal parts.

21. The tool of claim 10, wherein said means for measuring stresses due to shear and bending comprises one selected from the group consisting of a single extensometric sensor, a plurality of extensometric sensors arranged in a half bridge, a plurality of extensometric sensors arranged in a full bridge and a plurality of extensometric sensors arranged in multiple bridges.

* * * * *